US008915203B2

(12) United States Patent
Greer et al.

(10) Patent No.: US 8,915,203 B2
(45) Date of Patent: Dec. 23, 2014

(54) TRANSPORTING LIQUEFIED NATURAL GAS (LNG)

(75) Inventors: Matthew N Greer, Kingwood, TX (US); William H. Bray, The Woodlands, TX (US); Kevin L. Morath, Grosse Pointe Woods, MI (US)

(73) Assignee: ExxonMobil Upstream Research Company, Houston, TX (US)

( * ) Notice: Subject to any disclaimer, the term of this patent is extended or adjusted under 35 U.S.C. 154(b) by 284 days.

(21) Appl. No.: 13/442,434

(22) Filed: Apr. 9, 2012

(65) Prior Publication Data

US 2012/0294702 A1 Nov. 22, 2012

Related U.S. Application Data

(60) Provisional application No. 61/487,345, filed on May 18, 2011.

(51) Int. Cl.
*B63B 25/08* (2006.01)
*B63B 39/00* (2006.01)

(52) U.S. Cl.
CPC ..... *B63B 25/08* (2013.01); *F17C 2260/016* (2013.01); *F17C 2270/105* (2013.01)
USPC ..... 114/74 R; 414/803

(58) Field of Classification Search
USPC ..... 141/1; 414/803; 114/74 R, 74 T, 74 A
See application file for complete search history.

(56) References Cited

U.S. PATENT DOCUMENTS 3,422,781 A 1/1969 Field et al.
3,544,289 A 12/1970 Berlin
4,308,815 A * 1/1982 Conway ..... 114/74 R
5,375,547 A * 12/1994 Abe et al. ..... 114/74 A
5,492,075 A 2/1996 Lerstad et al.
6,094,937 A * 8/2000 Paurola et al. ..... 62/613
6,546,739 B2 * 4/2003 Frimm et al. ..... 62/50.2
RE38,697 E * 2/2005 Swann et al. ..... 114/61.1
7,137,345 B2 * 11/2006 Noble et al. ..... 114/74 R (Continued)

FOREIGN PATENT DOCUMENTS

WO WO2008/076168 6/2008
WO WO2009/119953 10/2009

OTHER PUBLICATIONS

McGuire, et al. (2000), "Liquefied Gas Handling Principles on Ships and in Terminals", SIGTTO (Society of International Gas Tanker & Terminal Operators Ltd., Bermuda) *Witherby & Company Limited*, London, Third Edition, England; pp. 165-166.

(Continued)

*Primary Examiner* — Nicolas A Arnett
(74) *Attorney, Agent, or Firm* — ExxonMobil Upstream Research Company—Law Department

(57) ABSTRACT

There is provided a method for loading or unloading a liquid cargo for a water-borne vehicle. An exemplary method comprises distributing liquid cargo to a first storage compartment of the water-borne vehicle to a first level. The exemplary method additionally comprises distributing liquid cargo to a second storage compartment of the water-borne vehicle to a second level different from the first level so that a natural period of the first storage compartment is separated relative to a natural period of the second storage compartment to reduce sloshing of the liquid cargo. An exemplary water-borne vehicle and method of producing hydrocarbons are also provided.

19 Claims, 4 Drawing Sheets

Staggered Levels

400

(56) References Cited

U.S. PATENT DOCUMENTS

| | | | | |
|---|---|---|---|---|
| 7,311,054 | B2 * | 12/2007 | Noble et al. | 114/74 R |
| 8,079,321 | B2 * | 12/2011 | Balasubramanian | 114/74 R |
| 8,235,242 | B2 * | 8/2012 | Ha | 220/563 |
| 8,561,631 | B2 * | 10/2013 | Yung et al. | 137/209 |
| 8,643,509 | B1 * | 2/2014 | Chen et al. | 114/74 R |
| 2005/0150443 | A1 * | 7/2005 | Noble et al. | 114/74 R |
| 2005/0193938 | A1 * | 9/2005 | Boatman et al. | 114/230.1 |
| 2006/0180231 | A1 * | 8/2006 | Harland et al. | 141/1 |
| 2009/0158986 | A1 * | 6/2009 | Kim et al. | 114/256 |
| 2010/0018453 | A1 * | 1/2010 | Balasubramanian | 114/74 R |
| 2010/0162939 | A1 * | 7/2010 | Morimoto | 114/74 R |
| 2010/0281887 | A1 * | 11/2010 | Ha | 62/53.2 |

OTHER PUBLICATIONS

S. A. Malliaroudakis Maritime Ltd (2009), "MultiLoad for Windows" http://www.smmnet.com/multiload_windows.html.

* cited by examiner

100

200

300

400

500

TRANSPORTING LIQUEFIED NATURAL GAS (LNG)

CROSS-REFERENCE TO RELATED APPLICATION

This application claims the priority benefit of U.S. Provisional Patent Application No. 61/487,345 filed May 18, 2011 entitled TRANSPORTING LIQUEFIED NATURAL GAS (LNG), the entirety of which is incorporated by reference herein.

FIELD OF THE INVENTION

The present techniques relate to transporting liquid natural gas (LNG). In particular an exemplary system and method relates to loading and unloading LNG carriers.

BACKGROUND

This section is intended to introduce various aspects of the art, which may be associated with embodiments of the disclosed techniques. This discussion is believed to assist in providing a framework to facilitate a better understanding of particular aspects of the disclosed techniques. Accordingly, it should be understood that this section is to be read in this light, and not necessarily as admissions of prior art.

Loading and unloading of liquefied natural gas (LNG) carriers during transport can be disrupted by sloshing of the LNG cargo. A typical LNG delivery chain includes:

- gas production from underground reservoirs,
- gas processing/treating to remove heavier hydrocarbons and undesirable components, such as hydrogen sulfide and carbon dioxide,
- a liquefaction plant to refrigerate the natural gas to a liquid state for storage and transport,
- an export terminal facility, typically a harbor with berths for LNG carriers,
- LNG carrier ships for marine transportation of the LNG from the export terminal to the market location, and
- an import terminal at the market location to receive the LNG from the LNG carrier ships and vaporize the LNG into natural gas to be transmitted to the market by pipeline.

In order minimize onshore impacts, enter new sales markets or capture new gas resources, there has been a desire to utilize offshore LNG terminal concepts. These concepts may include the use of floating units (floating production/liquefaction/storage for export and floating storage/regasification for import) or fixed units such as Gravity Based Structures (GBS). These offshore terminals typically require the LNG carrier to be exposed to the environment (specifically waves) during cargo operations (loading and unloading). In the past, cargo operations occurred in sheltered harbors where the environmental conditions are not significant.

A factor in evaluating the feasibility of offshore LNG export and import terminals is the terminal's berth availability. In regards to an offshore LNG terminal, availability is defined as the percentage of time that, on average, a LNG carrier can safely perform cargo operations (loading or unloading). These operational limits are established by the capacities of the mooring system, loading/offloading systems and the capacity of the LNG carrier's cargo containment system (CCS) to withstand cargo sloshing loads due to ship motions resulting from the weather and wave conditions at the site.

During cargo operations, the LNG Carrier tanks will be in partially-filled conditions as they are loaded or unloaded. As with any liquid, a partially filled tank allows for motion of the liquid inside the tank when the tank is excited (moved). This motion can cause the liquid cargo to impact the tank which can result in large forces and pressures on the tank. If the capacity of the tank to resist these impacts is lower than the resulting forces and pressures, damage to the tank may occur.

LNG cargo sloshing has the potential to damage the CCS aboard LNG carriers. Vessel motions drive cargo sloshing, which results in pressures and loads on the cargo tanks The LNG carrier motions are mainly driven by the LNG carrier design, LNG carrier loading condition (cargo tank filling levels, weight/displacement, centers of gravity, etc.) and the wave conditions (wave direction relative to LNG carrier, wave period and wave height).

Because the majority of LNG cargo operations have historically taken place in sheltered harbors, the impact of partial fill operations and the environment (waves) has been limited. With the need to perform cargo operations increasing for exposed/offshore berths, the potential for partial fill sloshing damage will be a key issue in determining terminal operability limits and project feasibility/economics. Current analysis highlights the challenges of achieving acceptable levels of availability with industry standard ships at offshore terminals. Reduction of sloshing loads and/or increased CCS structural capacity may help to meet availability requirements.

The ability to control the heading of a floating terminal is one technique to reduce the impact of cargo sloshing. In systems that provide this capability, the heading of the LNG Carrier may be altered with respect to the waves. This prevents the LNG Carrier from being exposed to beam seas and/or to allow the terminal to provide shelter. However, fixed terminals are not able to be positioned relative to waves. Additionally, repositioning is not as effective when the direction of the wind driven and swell waves are greatly separated.

Another potential strategy for dealing with cargo sloshing is the use of dedicated (i.e., purpose-built) LNG carriers. Dedicated LNG carriers may be built specifically for use at offshore terminals. Such dedicated LNG carriers may include strengthened membranes, subdivided membrane tanks, a MOSS containment system or an IHI SPB containment system. However, the strengthened membrane may not increase capacity enough to significantly improve operability. Requiring purpose built ships may reduce the marketing and commercial flexibility of the terminal by eliminating some industry standard ships from consideration for spot or short term charters.

SUMMARY

An exemplary embodiment of the present techniques comprises a method for loading or unloading cargo for a water-borne vehicle. An exemplary method comprises distributing liquid cargo to a first storage compartment of the water-borne vehicle to a first level. The exemplary method additionally comprises distributing liquid cargo to a second storage compartment of the water-borne vehicle to a second level different from the first level so that a natural period of the first storage compartment is separated relative to a natural period of the second storage compartment to reduce sloshing of the liquid cargo. An exemplary water-borne vehicle and method of producing hydrocarbons are also provided.

An exemplary water-borne vehicle for transporting liquid cargo according to the present techniques comprises a first storage compartment having liquid cargo distributed to a first fill level. The exemplary water-borne vehicle also comprises a second storage compartment having liquid cargo distributed to a second fill level different from the first fill level so that a natural period of the first storage compartment is separated relative to the second storage compartment to reduce sloshing of the liquid cargo.

A method for producing hydrocarbons from an oil and/or gas field according to the present techniques comprises extracting hydrocarbons from the oil and/or gas field. The extracted hydrocarbons are liquefied to produce a liquid cargo. The exemplary method further comprises distributing the liquid cargo to a first storage compartment of a water-borne vehicle to a first level. The exemplary method additionally comprises distributing the liquid cargo to a second storage compartment of the water-borne vehicle to a second level different from the first level so that a natural period of the first storage compartment is separated relative to a natural period of the second storage compartment. According to the subject innovation, the separation of the natural periods between the storage compartments is sufficient to reduce sloshing of the liquid cargo.

BRIEF DESCRIPTION OF THE DRAWINGS

Advantages of the present techniques may become apparent upon reviewing the following detailed description and drawings of non-limiting examples of embodiments in which.

DETAILED DESCRIPTION

In the following detailed description section, specific embodiments are described in connection with preferred embodiments. However, to the extent that the following description is specific to a particular embodiment or a particular use, this is intended to be for exemplary purposes only and simply provides a description of the exemplary embodiments. Accordingly, the present techniques are not limited to embodiments described herein, but rather, it includes all alternatives, modifications, and equivalents falling within the spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent.

Exemplary embodiments of the present techniques relate to reducing cargo sloshing on LNG carriers during cargo operations at offshore LNG terminals with exposed berths. Moreover, exemplary embodiments may be applied to any vessel with multiple tanks carrying liquid cargo.

Figure 1:
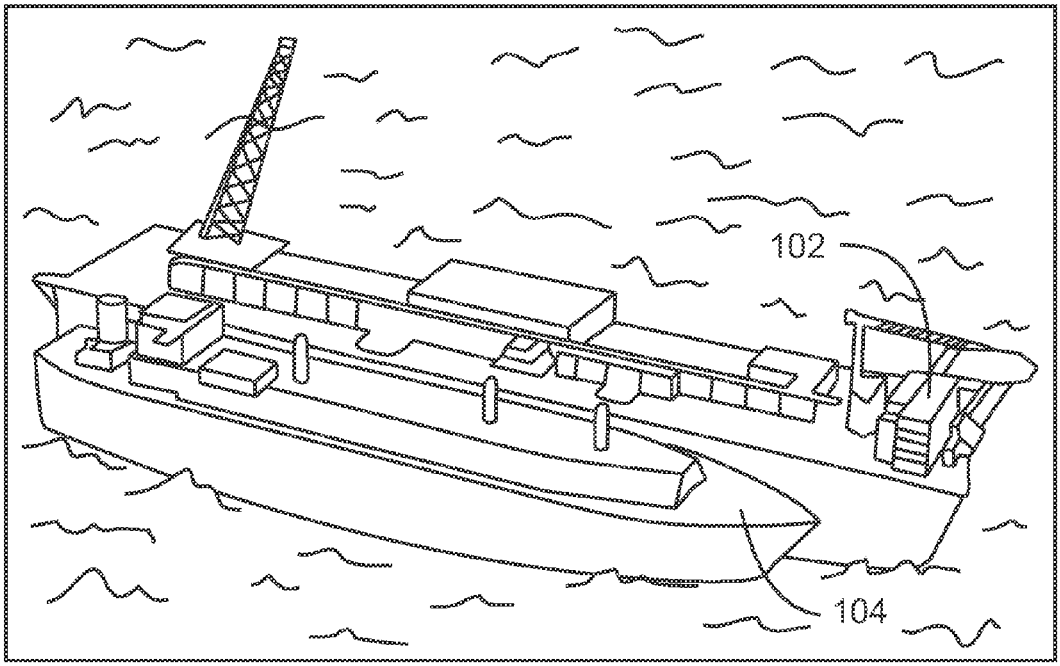
FIG. 1 is a diagram showing an example of an offshore LNG terminal in which an exemplary embodiment of the present technique may be practiced.

FIG. 1 is a diagram 100 showing an example of an offshore LNG terminal 102 in which an exemplary embodiment of the present technique may be practiced. A LNG carrier 104 is depicted adjacent to the LNG terminal 102 for loading and/or unloading. The LNG carrier, which may be referred to in the art as a membrane-based ship, has storage compartments that are generally rectangular.

When a liquid cargo carrier is loading or offloading at an offshore terminal, it will be exposed to the environment (waves) with partially filled cargo tanks. When the vessel moves due to the environment, the cargo in the tanks will also begin to move. According to the present techniques, reduced vessel motion and liquid cargo motion are intended to reduce the sloshing impact pressures caused by cargo sloshing.

Figure 2:
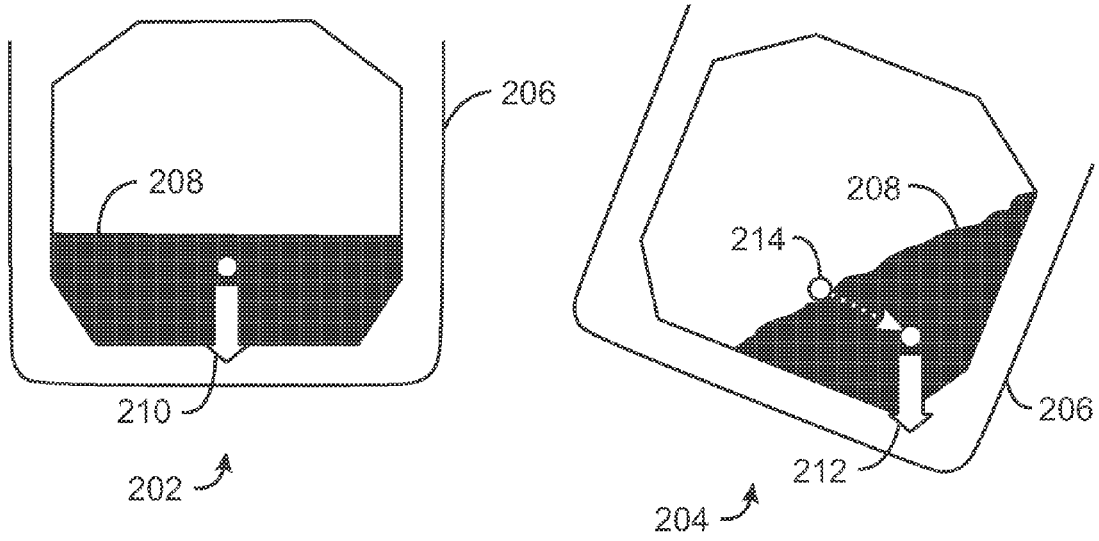
FIG. 2 is a diagram showing cross-sectional views of storage compartments to illustrate the problem of cargo sloshing during LNG transport.

FIG. 2 is a diagram 200 showing cross-sectional views of storage compartments to illustrate the problem of cargo sloshing during LNG transport. The diagram 200 includes a left panel 202 showing a storage compartment 206 in a first position. A liquid cargo 208 exerts a force 210 from the center of gravity (COG) of the liquid cargo 208 in the first position.

A right panel 204 shows the storage compartment 206 in a second position as a result of cargo sloshing, which may occur because of waves striking a vessel in which the storage compartment 206 is disposed. In the right panel 204, the liquid cargo 208 has shifted as a result of cargo sloshing. The liquid cargo 208 now exerts a force 212 on the storage container 206 from the center of gravity of the liquid cargo 208 in the second position. The center of gravity in the second position is offset relative to its center of gravity in the first position, as shown by a vector 214.

The change of position of the storage compartment 206 from the left panel 202 to the right panel 204 represent what would happen on a vessel such as a LNG carrier with partially filled tanks in a roll motion. As shown, when the vessel rolls, the liquid and its center of gravity shift in the direction of the vessel movement. This shifting of the liquid weight and center of gravity causes a different rolling moment/motion of the vessel compared to a solid cargo. Because of this, the vessel motions and liquid cargo motions are coupled, meaning that vessel motions have an impact on liquid cargo motions, and liquid cargo motions have an impact on vessel motions.

The liquid cargo motion will be greatest when the liquid is excited at the natural sloshing period of the tank. The natural period of the tank is dependent on the length and width of the tank as well as the liquid height in the tank. Since the tank length and width are fixed, the liquid height is the main parameter in operation. Typical loading and offloading operations discharge the tanks at the same rate to minimize the time at berth, causing the natural periods of the tanks to be similar. If the vessel is excited near the tank sloshing natural period the effect will be large cargo motions and large vessel motions due to coupling.

Figure 3:
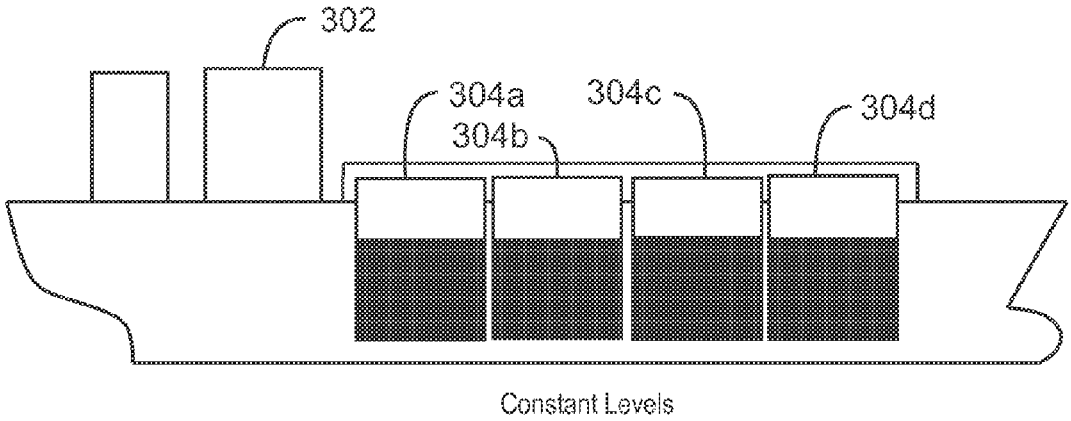
FIG. 3 is a diagram showing a cross-sectional view of a LNG carrier that may be susceptible to cargo sloshing.

FIG. 3 is a diagram 300 showing a cross-sectional view of a LNG carrier 302 that may be susceptible to cargo sloshing. The LNG carrier 302 has a plurality of storage compartments 304*a*, 304*b*, 304*c*, 304*d*, each filled with about the same amount of liquid cargo.

Figure 4:
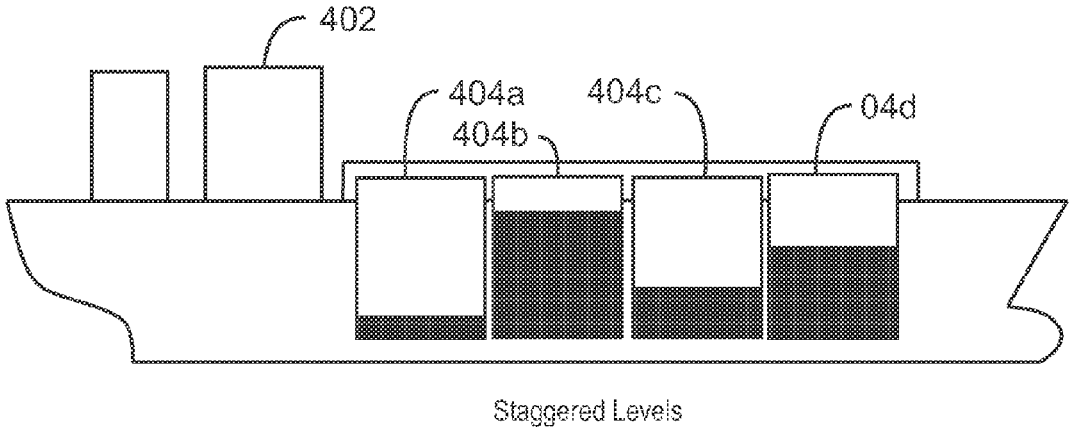
FIG. 4 is a diagram showing a cross-sectional view of a LNG carrier arranged according to an exemplary embodiment of the present techniques to reduce the effects of cargo sloshing.

FIG. 4 is a diagram 400 showing a cross-sectional view of a LNG carrier 402 arranged according to an exemplary embodiment of the present techniques to reduce the effects of cargo sloshing. The LNG carrier 402 has a plurality of storage compartments 404*a*, 404*b*, 404*c*, 404*d*. According to the present techniques, the levels of liquid cargo in each of the storage compartments 404*a*, 404*b*, 404*c*, 404*d* is staggered to prevent excessive motion because of cargo sloshing.

According to the present techniques, the fill heights of separate cargo tanks may be staggered in order to separate the natural periods of the tanks. Moreover, giving different storage compartments different fill heights makes the natural period of each tank different so that adjacent tanks resist motion attributable to motion at the natural period of any one of the storage compartments. Moreover, by separating fill levels and thus the natural periods of the tanks, the vessel-cargo coupling effect may be reduced, decreasing the motions of the vessel and liquid cargo. The motion most affected by this is the roll motion, but sway motion will also be affected.

Figure 5:
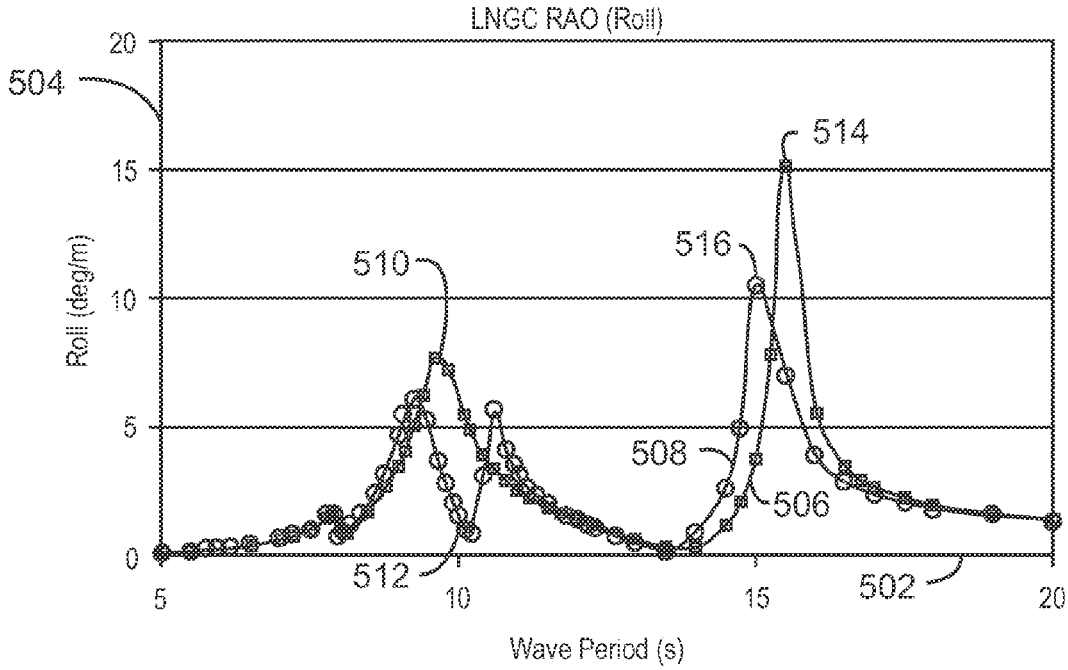
FIG. 5 is a graph that is useful in explaining reduction of cargo sloshing according to an exemplary embodiment of the present techniques.

FIG. 5 is a graph 500 that is useful in explaining reduction of cargo sloshing according to an exemplary embodiment of the present techniques. The graph 500 has an x-axis 502 representative of a wave period in units of seconds. A y-axis 504 represent roll in units of degrees per meter. A trace 506 represents the modelling of performance of a LNG carrier employing constant fill levels for all of its storage compartments, as discussed herein with reference to FIG. 3. A trace 508 represents the modelling of performance of a LNG carrier employing staggered fill levels for its storage compartments, as discussed herein with reference to FIG. 4.

The traces shown in FIG. 5 show the impact of coupling through the response amplitude operator (RAO) for roll motion of a LNG Carrier. In this case, the RAO shows the amount of roll per meter of wave height for a range of wave periods. An important area of the RAO according to the present techniques is the peak between 8 and 12 seconds. These peaks are caused by the vessel-cargo coupling. The difference between the magnitude and location of the peaks of the RAO illustrates the potential for the staggered filling height to affect vessel motions. In particular, a peak 510 on the constant fill level trace 506 represents a natural period attributable to the storage compartments of a LNG carrier. The peak 510 corresponds to a roll of about eight degrees per meter. In contrast, a valley 512 on the staggered fill level trace 508, also represents a natural period attributable to the storage compartments of a LNG carrier. The valley 512 corresponds to a roll of about one degree per meter. Thus, the use of staggered fill levels is believed to significantly reduce roll attributable storage compartments of a LNG carrier.

As explained herein, the roll attributable to the hull of a LNG carrier is coupled to the roll attributable to the storage compartments of the LNG carrier. A peak 514 on the constant fill level trace 506 represents a natural period attributable to the ship hull of a LNG carrier. The peak 514 corresponds to a roll of about 15 degrees per meter. In contrast, a peak 516 on the staggered fill level trace 508, also represents the natural period attributable to the hull of the LNG carrier. The peak 516 corresponds to a roll of about 11 degrees per meter. Thus, the use of staggered fill levels is believed to significantly reduce the roll attributable to the hull of a LNG carrier.

According to one exemplary embodiment, hydrocarbons may be produced using the present techniques. In such an embodiment, hydrocarbons are extracted from a subsurface region of the earth. The hydrocarbons may be loaded or unloaded in storage compartments in a water-borne vehicle, such as a LNG carrier having a plurality of storage compartments. When the liquefied hydrocarbons are placed in the storage compartments or removed therefrom, fill levels may be staggered between the plurality of storage compartments so that natural periods of the storage compartments are different. In this manner, cargo sloshing and its attendant damage are avoided.

In one exemplary embodiment, fill levels for the storage compartments may be determined using cargo control software that would manage the fill levels during loading and unloading. Moreover, the fill levels may be determined to provide effective separation of the natural periods of the storage compartments.

The present techniques may be susceptible to various modifications and alternative forms, and the exemplary embodiments discussed above have been shown only by way of example. However, the present techniques are not intended to be limited to the particular embodiments disclosed herein. Indeed, the present techniques include all alternatives, modifications, and equivalents falling within the spirit and scope of the appended claims.

What is claimed is:

1. A method for loading or unloading liquid cargo for a water-borne vehicle, the method comprising:

distributing liquid cargo to a first storage compartment of the water-borne vehicle to a first level;

distributing liquid cargo to a second storage compartment of the water-borne vehicle to a second level; and distributing liquid cargo to a third storage compartment of the water-borne vehicle to a third level, wherein adjacent storage compartments have different levels of liquid cargo so that a natural period of the first storage compartment, the second storage compartment and the third storage compartment are separated to reduce sloshing of the liquid cargo.

2. The method for loading or unloading liquid cargo recited in claim 1, wherein the liquid cargo comprises liquefied natural gas (LNG).

3. The method for loading or unloading liquid cargo recited in claim 1, wherein the water-born vehicle comprises a liquefied natural gas (LNG) carrier.

4. The method for loading or unloading liquid cargo recited in claim 3, wherein the LNG carrier comprises a membrane-based LNG carrier.

5. The method for loading or unloading liquid cargo recited in claim 1, comprising docking the water-borne vehicle at an offshore terminal.

6. The method for loading or unloading liquid cargo recited in claim 5, comprising delivering the liquid cargo to the offshore terminal.

7. The method for loading or unloading liquid cargo recited in claim 1, comprising liquefying hydrocarbons to produce the liquid cargo.

8. A water-borne vehicle for transporting liquid cargo, comprising:

a first storage compartment having liquid cargo distributed to a first fill level; a second storage compartment having liquid cargo distributed to a second fill level; and a third storage compartment having liquid cargo distributed to a third fill level, wherein adjacent storage compartments have different fill levels so that a natural period of the first storage compartment, the second storage compartment, and the third storage compartment are separated to reduce sloshing of the liquid cargo.

9. The water-borne vehicle recited in claim 8, wherein the liquid cargo comprises liquefied natural gas (LNG).

10. The water-borne vehicle recited in claim 8, wherein the water-born vehicle comprises a liquefied natural gas (LNG) carrier.

11. The water-borne vehicle recited in claim 10, wherein the LNG carrier comprises a membrane-based LNG carrier.

12. The water-borne vehicle recited in claim 8, wherein the water-borne vehicle is docked at an offshore terminal.

13. The water-borne vehicle recited in claim 12, wherein the liquid cargo is delivered to the offshore terminal.

14. A method for producing hydrocarbons from an oil and/or gas field, the method comprising:

extracting hydrocarbons from the oil and/or gas field;

liquefying the extracted hydrocarbons to produce a liquid cargo;

distributing the liquid cargo to a first storage compartment of a water-borne vehicle to a first level;

distributing the liquid cargo to a second storage compartment of the water-borne vehicle to a second level; and distributing the liquid cargo to a third storage compartment of the water-borne vehicle to a third level, wherein adjacent storage compartments have different levels of liquid cargo so that a natural period of the first storage compartment, the second storage compartment and the third storage compartment are separated, the separation in natural periods being sufficient to reduce sloshing of the liquid cargo.

15. The method for producing hydrocarbons recited in claim 14, wherein the liquid cargo comprises liquefied natural gas (LNG).

16. The method for producing hydrocarbons recited in claim 14, wherein the water-born vehicle comprises a liquefied natural gas (LNG) carrier.

17. The method for producing hydrocarbons recited in claim 16, wherein the LNG carrier comprises a membrane-based LNG carrier.

18. The method for producing hydrocarbons recited in claim 14, comprising docking the water-borne vehicle at an offshore terminal.

19. The method for producing hydrocarbons recited in claim 18, comprising delivering the liquid cargo to the offshore terminal.

* * * * *